US007155822B2

(12) United States Patent
Decime et al.

(10) Patent No.: US 7,155,822 B2
(45) Date of Patent: Jan. 2, 2007

(54) CONNECTOR LOCKING DEVICE

(75) Inventors: Jerry Decime, Eagle, ID (US); Brenda A. Burget, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 249 days.

(21) Appl. No.: 10/917,670

(22) Filed: Aug. 13, 2004

(65) Prior Publication Data

US 2005/0015977 A1 Jan. 27, 2005

Related U.S. Application Data

(62) Division of application No. 10/379,651, filed on Mar. 5, 2003, now Pat. No. 6,802,723.

(51) Int. Cl.
*H01R 43/20* (2006.01)

(52) U.S. Cl. ..... 29/876; 29/825; 29/842

(58) Field of Classification Search ..... 29/825, 29/842, 876

See application file for complete search history.

(56) References Cited

U.S. PATENT DOCUMENTS

| | | | | |
|---|---|---|---|---|
| 4,222,089 | A * | 9/1980 | MacAskill et al. | 361/263 |
| 4,592,607 | A | 6/1986 | Pejovic | |
| 4,898,009 | A | 2/1990 | Lakoski et al. | |
| 4,975,550 | A | 12/1990 | Panchisin | |
| 5,052,939 | A | 10/1991 | Koch | |
| 5,139,429 | A | 8/1992 | Herman et al. | |
| 5,186,636 | A | 2/1993 | Boyer et al. | |
| 5,225,961 | A * | 7/1993 | Zander et al. | 361/641 |
| 5,253,143 | A * | 10/1993 | Klinger et al. | 361/736 |
| 5,338,211 | A | 8/1994 | Kodama et al. | |
| 5,642,805 | A | 7/1997 | Tefft | |
| 5,924,807 | A | 7/1999 | Ambrose et al. | |
| 5,930,111 | A * | 7/1999 | Yamazaki et al. | 361/690 |
| 6,012,941 | A | 1/2000 | Burdenko et al. | |
| 6,138,240 | A | 10/2000 | Tran et al. | |
| 6,185,964 | B1 | 2/2001 | Addiego | |
| 6,234,823 | B1 | 5/2001 | Fuess | |
| 6,398,578 | B1 | 6/2002 | Huang et al. | |
| 6,401,504 | B1 | 6/2002 | Derman et al. | |
| 6,422,892 | B1 | 7/2002 | Chen et al. | |
| 6,514,095 | B1 * | 2/2003 | Smith et al. | 439/306 |

* cited by examiner

*Primary Examiner*—Carl J. Arbes

(57) ABSTRACT

A locking device for a connector that can be readily adapted to an existing electronics enclosure such as personal computer. Preferably the locking device has one or more sheathing members that form a hollow space for at least partially retaining a connector. The sheathing member has one or more openings connecting the hollow space inside the sheathing member with the space outside of the sheathing member. The openings are adapted to permit the connector to be connected to a mating connector and to provide for at least partial entry of a cable that is associated with the connector. Finally, the sheathing member has one or more projecting members for securing the connector locking device to the electronics enclosure.

19 Claims, 5 Drawing Sheets

CONNECTOR LOCKING DEVICE

CROSS-REFERENCE TO RELATED APPLICATIONS

This application is a divisional of U.S. patent application Ser. No. 10/379,651, filed Mar. 5, 2003, now U.S. Pat. No. 6,802,723, and titled "Connector Locking Device."

FIELD OF THE INVENTION

The invention relates generally to devices used in connection with electronic equipment. It finds particular application to a method and system of securing input and output connectors to electronics enclosures, such as computers.

BACKGROUND OF THE INVENTION

Computers are used in just about every business and government organization. Computers perform many services, such as aiding in word processing, controlling complex equipment, and storing and accessing large databases. As more information, software, and confidential information are stored on computers, a need arises to protect this information from unauthorized access.

One way of preventing access to the information is to restrict access to the computers. Several methods are used to prevent unauthorized access, such as locking the computers in a separate room, covering or locking the keyboard and/or mouse when the operator is not present, or installing a key switch in the cable leading from the keyboard to the computer. While preventing unauthorized access, these methods suffer from several disadvantages. Providing a secure room is not always feasible do to lack of space or inconvenience of operation. Mechanical devices are cumbersome, and take time and effort to use. In addition, the devices are not used when the operator only plans to be away for a brief period of time.

Another method to restrict access to a computer is to provide a password system in the computer's software. Password protection is the most common method used to prevent unauthorized access to computers and sensitive electronics. The sophistication of the password protection software is selected based on the sensitivity of the information that is being protected. The most sophisticated software, however, can be defeated if the unauthorized user has the password.

The desire to infiltrate these systems has led to the development of in-line listening devices. The in-line listening devices are inserted in-line with an input device, such as between the keyboard DIN connector and the mating connector on the computer. When the operator enters her password to access the computer, the in-line listening device intercepts and stores the password. The unauthorized intruder later removes the listening device and retrieves the password. To combat the threat of in-line listening devices, "high security" systems monitor the input connection to the computer. If the connection is interrupted at any time before the operator logs on to the system the operator is alerted to the interruption of the connection, and the possible breach of security.

Software monitoring of the input device connection, however, does not provide sufficient protection to prevent in-line listening devices from being installed. Operators often dismiss the notification if the message is displayed frequently. For example, if the input connector is disconnected and reconnected on a nightly basis most operators will stop inspecting the connection and simply dismiss the security alert as a computer error. After a brief time, the in-line listening device can be inserted without the threat of detection.

As a result, there exists a need to solve the aforementioned deficiencies in the prior art, that is low cost, readily adaptable to existing computers, and easy to install.

SUMMARY OF THE INVENTION

One embodiment of the present invention provides a method of securing a connector to an electronic enclosure that includes, for example, installing a sheathing device at least partially around a connector and securing the sheathing device to the electronic enclosure. The sheathing device need only at least partially retain the connector.

Embodiments of the invention can be used with personal computers and their input/output connectors, such as keyboard connectors, mouse connectors, phone jacks, Ethernet connectors, network cables, banana connectors, etc. In addition, embodiments of the invention can be used with any electronic enclosure where it is desirable to prevent the unauthorized disconnection of a connector.

DETAILED DESCRIPTION OF ILLUSTRATED EMBODIMENT

The invention relates generally to connector locking devices and methods for preventing the unauthorized disconnection of input and output connectors. In that respect a number of preferred embodiments are described in detail below and are used to illustrate the spirit and concept of the present invention and are not intended to limit the scope of the invention.

Figure 1A:
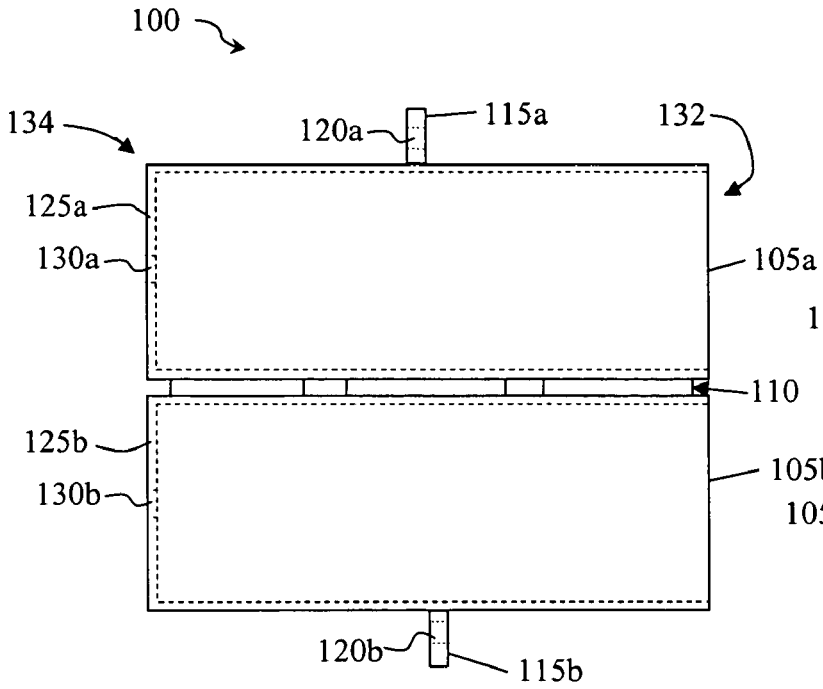
FIG. 1A is an exemplary plan view of one embodiment of a connector locking device, shown in an open position, in accordance with the present invention.
Figure 1B:
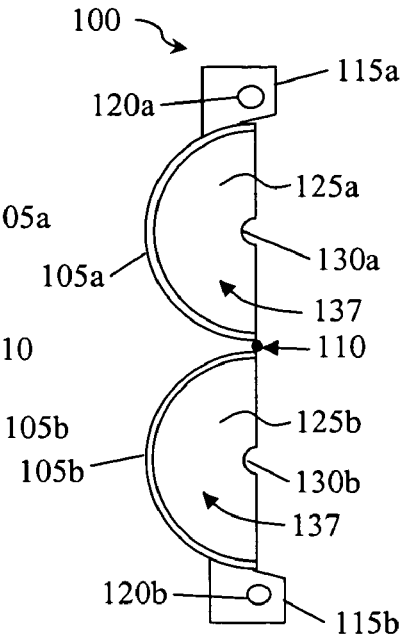
FIG. 1B is an exemplary end view of the embodiment of FIG. 1A, shown in an open position, in accordance with the present invention.
Figure 1C:
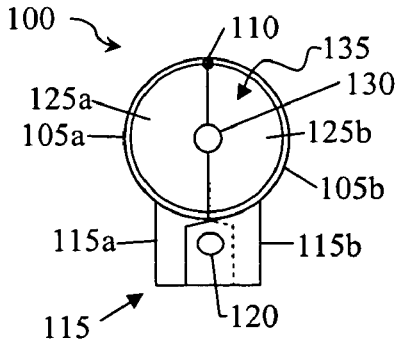
FIG. 1C is an exemplary end view of the embodiment of FIG. 1A, shown in a closed position, in accordance with the present invention.

FIGS. 1A, 1B and 1C illustrate one embodiment of a connector locking device 100 in accordance with the present invention. The connector locking device 100 is shown in an open position in FIGS. 1A and 1B, and is shown in the closed position in FIG. 1C. The connector locking device 100 comprises two semi-cylindrical sheathing members 105*a* and 105*b* that are pivotally connected along one longitudinal axis by a hinge member 110. Each sheathing member 105*a*, 105*b* has a projecting member 115*a*, 115*b*, respectively attached thereto. The projecting member 115*a* has a first opening 120*a* and projecting member 115*b* has an opening 120*b* that correspond to the size and shape of a post member (see FIG. 2A). In addition, each sheathing member 105*a*, 105*b* has an end cover 125*a*, 125*b*, respectively affixed to one end collectively forming one end portion of the sheathing members 105*a*, 105*b*. The end covers 125*a*, 125*b* have a semi-circular recess 130*a*, 130*b*, respectively in them.

As is readily apparent in FIG. 1C, the sheathing member 105*a* and sheathing member 105*b* pivot about the hinge member 110 and form a substantially cylindrical shape when in the closed position. In this position, the semi-cylindrical sheathing members 105*a*, 105*b* define, a hollow space 137 (FIG. 1B) and have a first end portion 132 and a second end portion 134 (FIG. 1A). The sheathing members 105*a*, 105*b* form a first opening 135 between the hollow space 137 inside the connector locking device 100 and the space outside of the connector locking device 100. In addition, the second end portion 134 of the sheathing members 105*a*, 105*b* are formed by the end covers 125*a*, 125*b* located on the end opposite of the first opening 135 and are configured to provide a second opening 130 that is formed by the semi-circular recesses 130*a* and 130*b*. The projecting member 115*a* of the sheathing member 105*a* has a first opening 120*a* and projecting member 115*b*, of the sheathing member 105*b* has a second opening 120*b*. The first opening 120*a* and second opening 120*b* are substantially concentric when the connector locking device 100 is in the closed position and together form aperture 120. As will be discussed below, aperture 120 is configured to receive a post member (see FIG. 2B) there through.

Figure 2A:
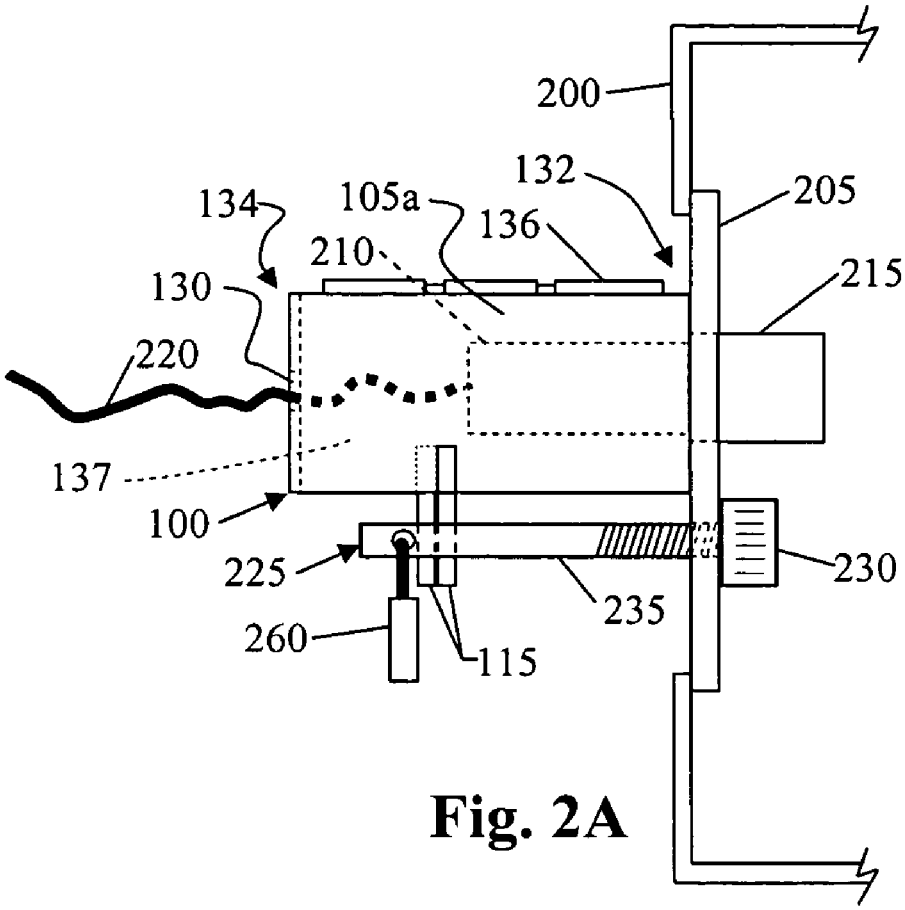
FIG. 2A is an exemplary side view of the embodiment of FIG. 1A secured to an electronics enclosure in accordance with the present invention.
Figure 2B:
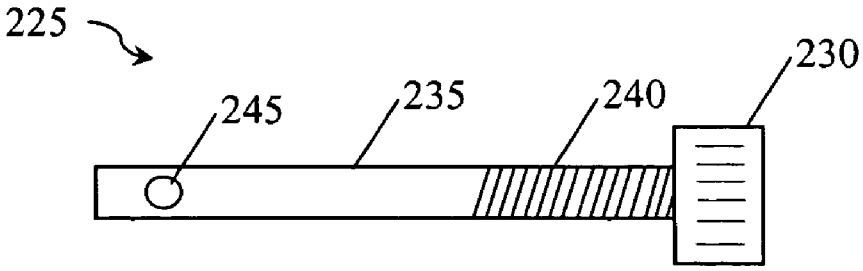
FIG. 2B is an exemplary view of an embodiment of a post member in accordance with the present invention.

Referring now to FIGS. 2A and 2B, the operation of the present embodiment will be discussed. A user connects an input device connector 210 to its mating connector 215 on an electronic enclosure 200. The connector 210 is preferably a Deutsches Institut fur Normung (German Standards Institute) connector, hereinafter a DIN connector, commonly used in connection with keyboards and computers. DIN connectors are generally either full size, ½ inch diameter, or mini size, 5/16" diameter, and the present invention can easily accommodate these and many other types and sizes of connectors, such as mouse connectors, phone jacks, Ethernet adapters, network cables, banana plug connectors, etc. Typically mating connector 215 is pre-mounted to a back plane 205 of an electronic enclosure 200, and is in circuit communication with the electronics that are housed therein. As a result, the peripheral device (not shown) attached to the connector 210 is put in circuit communication with the electronics.

A post member 225 can be provided with the electronics enclosure 200 or supplied with the connector locking device 100. The shaft 235 of post member 225 is inserted through a hole in the back plane 205. The hole in the back plane 205 may be an existing hole or a hole that is specifically made and sized to accept the shaft 235 of post member 225, but small enough so that the nut 230 of post member 225 cannot be pulled though the enclosure back plane 205.

The preferred post member 225, shown in detail in FIG. 2B, is comprised of a shaft 235, an aperture 245 configured to receive a locking device 260, and a threaded nut 230. Preferably, at least a portion of the shaft 235 has threads 240 to accept the threaded nut 230. The threads 240 permit the length of the post member 225 projecting beyond the back plane 205 to be adjusted.

Referring back to FIG. 2A, the user opens the connector locking device 100 wide enough to pass cable 220 through opening 130. The user then closes the locking device 100 so that the locking device 100 forms a substantially cylindrical shape and the cable 220 projects through opening 130 in the end portion of the sheathing members 105*a*, 105*b* formed by end covers 125*a*, 125*b*. The connector locking device 100 is positioned so that the second opening 135 (FIGS. 1A, 1B and 1C) formed by the sheathing members 105*a*, 105*b* can be slid over connector 210. The user then slides the connector locking device 100 up over the connector 210 so that the aperture 120 (FIG. 1C) of the projecting member 115 fits over shaft 235 of the post member 225 and the connector locking device 100 at least partially retains connector 210 within the hollow space 137. The locking device 260 is secured to the post member 225 so that the aperture 120 (FIG. 1C) cannot be removed form the post member 225 without removing the locking device 260.

The locking device 260 can be any conventional locking device such as a pad lock or a cylindrical lock integrated in the shaft 235 of the post member 225. Further the locking device can utilize any conventional method to alternate between the locked state and the unlocked state, including but not limited to a key or a combination of numbers. Preferably, the projection aperture 120 and post member shaft 235 are the same geometric shape. Still more preferably, the geometric shape is one that prevents the post member 225 from rotating while the shaft 235 is positioned through the projection aperture 120. For example, if a shaft has a rectangular shape then it can not be rotated once it is inserted through a rectangular aperture.

Figure 3A:
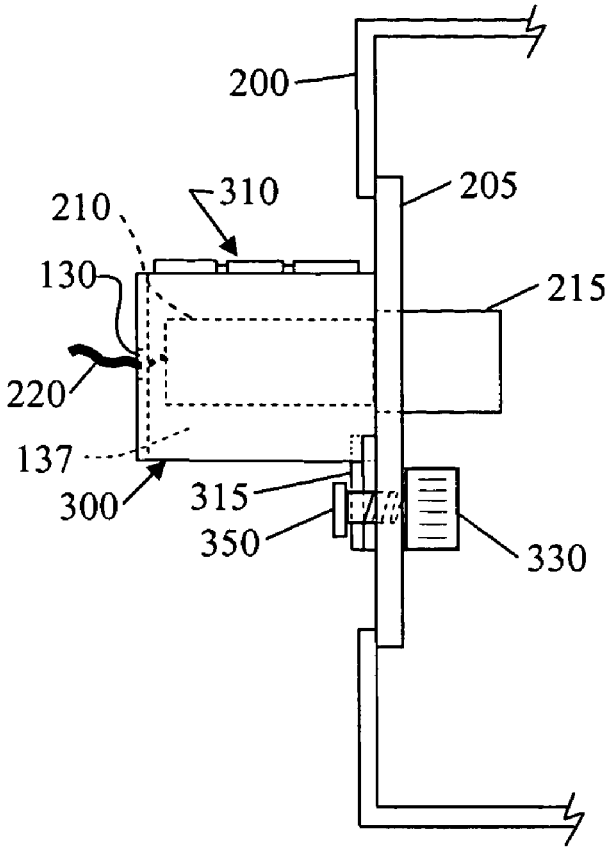
FIG. 3A is an exemplary side view of another embodiment of a connector locking device secured to an electronics enclosure in accordance with the present invention.
Figure 3B:
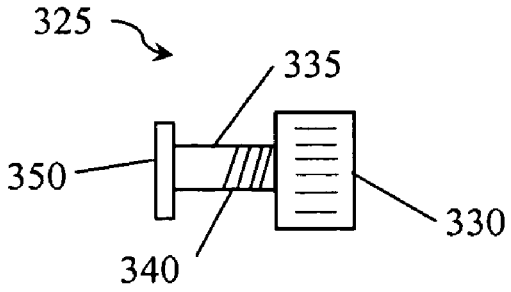
FIG. 3B is an exemplary view of another embodiment of a post member in accordance with the present invention.

FIGS. 3A and 3B illustrates another embodiment of the present invention that is similar to the embodiment described above. The locking device 300 differs from locking device 100 in that the projections 315 are affixed substantially adjacent to the first opening 135. In addition, the post member 325 is different then the post member 225 described above.

The post member 325 is comprised of a head 350 that is permanently attached to the shaft 335, a threaded portion 340 of the shaft 335 and a threaded nut 330. The head 350 can be formed by any conventional method such as expanding the end portion of the shaft 235 or simply crimping the end portion of the shaft 325 so that it cannot fit through the aperture (not shown) in the projecting member 315. In operation, the locking device 300 is installed in substantially the same way as described above, with the exception that the post member 325 is inserted through the aperture (not shown) of the projecting member 315 and then through the back plane 205 so that the threaded portion 340 of the shaft 335 projects through the back plane 205. The nut 330 is then tightened down on the shaft 335 securing the locking device 300 to the electronics enclosure 200.

Referring to FIGS. 2A, 2B, 3A and 3B. A locking device 260 and aperture 245 similar to those described above, can be provided in place of the nut 330 and the treaded portion 340 of the shaft 335. As a result, the post member 325 is inserted through the aperture of the projecting member 315 and then through the back plane 205 and into electronic enclosure 200 so that the locking device 260 engages the post member 325 from within the electronic enclosure 200.

Figure 4A:
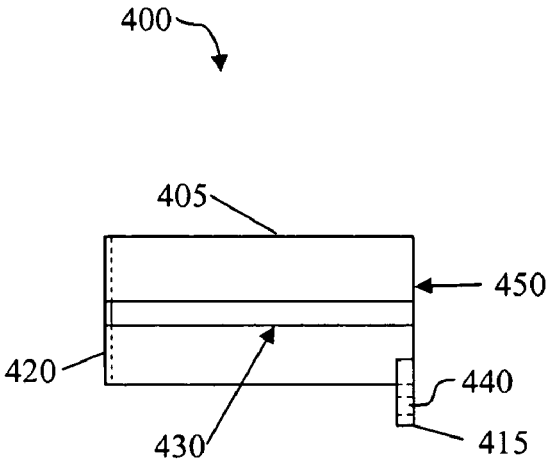
FIG. 4A is an exemplary side view of yet another embodiment of a connector locking device in accordance with the present invention.
Figure 4B:
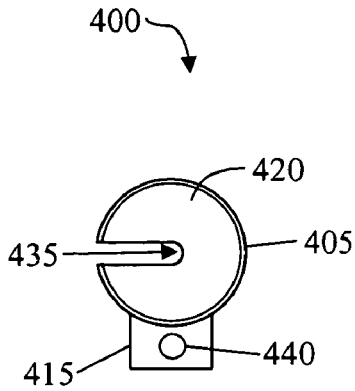
FIG. 4B is an exemplary end view of the embodiment of FIG. 4A in accordance with the present invention.

Still yet, another embodiment of the present invention is shown in FIGS. 4A and 4B. The connector locking device 400 comprises a sheathing member 405 and a projecting member 415. The sheathing member 405 is cylindrically shaped and has a slot 430 along one side. The slot 430 is sized to permit the cable (not shown) to be freely passed there through. The slot 430 is connected to a first opening 450 in the connector locking device 400. The first opening 450 is configured to fit over the connector 210. The sheathing member 405 further comprises an end cover 420 that is circularly shaped and attached to one end. Preferably, the end cover 420 has a slot or opening 435 that is also sized to permit the cable 220 (FIG. 4C) to be freely passed there through. Alternatively, the cable 220 can exit the connector locking device 400 anywhere through the slot 430, which would eliminate the need for slot 435 in end cover 420. The slots 430 and 435 are aligned so the cable 220 exits the end cover 420 in substantially the center thereof. Finally, there is a projection member 415 attached to the end opposite the end cover 420. Alternatively, projection member 415 can be located any distance along sheathing member 405 away from end cover 420. Preferably, projection member 415 has an aperture 420 suitably sized to accept post member 225. Never the less, projecting member 415 can be affixed to the enclosure back plane 205 by any conventional means such as adhesive, epoxy, welding, etc. Furthermore, the post member 225 can be any retaining means including but not limited to members such as screws, bolts or rivets.

Figure 4C:
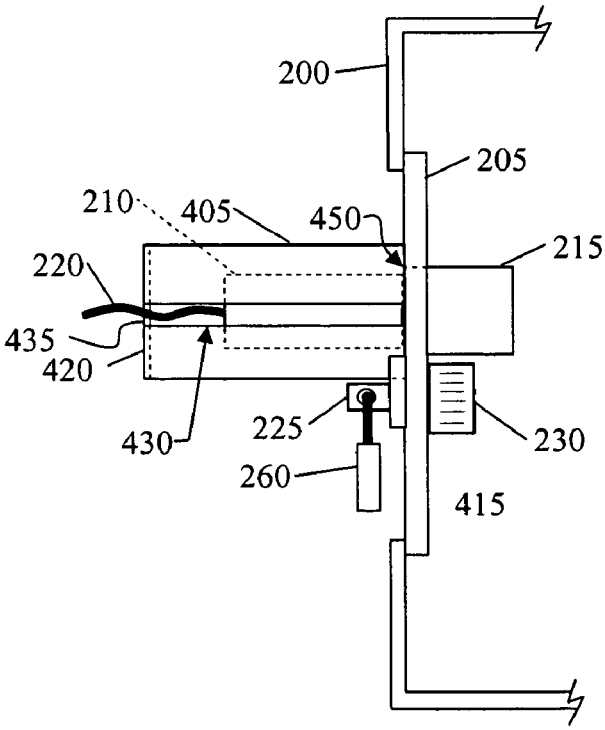
FIG. 4C is an exemplary side view of the embodiment of FIG. 4A secured to an electronics enclosure in accordance with the present invention.

In operation, as can seen in FIG. 4C, the user (1) inserts the cable 220 through the slots 430, 435 so that the first opening 450 is facing the connector 210, (2) slides the connector locking device 400 over the connector 210, and (3) secures the connector locking device 400 to the back plane 205 of the electronics enclosure 200 in a manner similar to that described above.

Figure 5A:
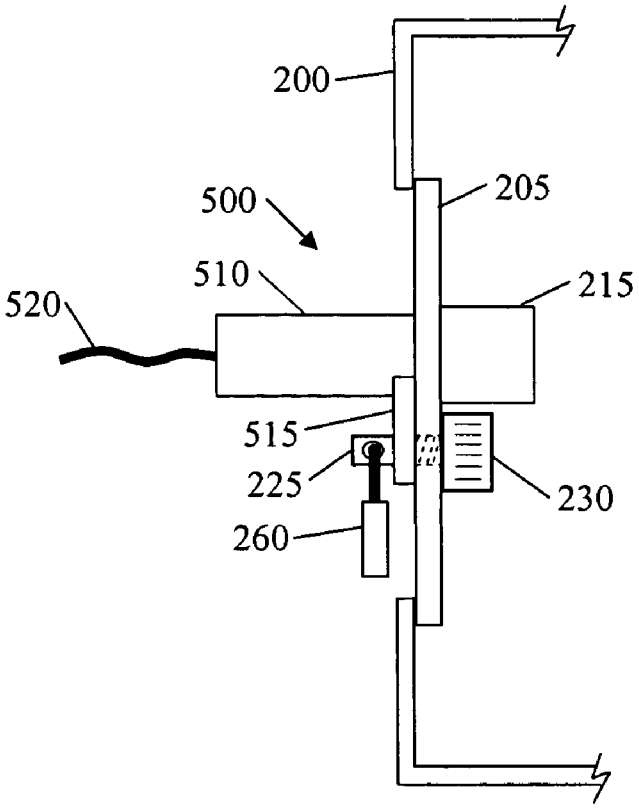
FIG. 5A is an exemplary side view of yet another embodiment of a connector locking device in accordance with the present invention.
Figure 5B:
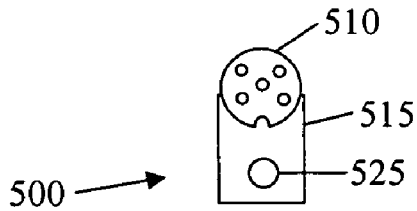
FIG. 5B is an exemplary end view of the embodiment of FIG. 5A in accordance with the present invention.

An additional embodiment is illustrated in FIGS. 5A and 5B and is directed to a connector 500 that has a projecting member 515 integrated into the body 510 of the connector. The projecting member 515 is configured to secure the connector body 510 to the back plane 205 of the electronics enclosure 200. Preferably the projecting member 515 is secured to a post member 225 that is secured to the back plane 205. The connector body 510 and projecting member 515 can be formed of any conventional material, such as metal, plastic, resin, etc.

The user plugs the connector body 510 into a mating connector 215 that is located in the back plane 205 of an electronics enclosure 200. Preferably, the projecting member 515 includes an aperture 525, similar to the apertures described in the earlier embodiments above. The connector body 510 is configured to align with its mating connector 215 in only one position. As a result, when the connector body 510 is properly connected to mating connector 215, the aperture 525 of projecting member 515 is automatically aligned with a hole (not shown) in the back plane 205. The aperture 525 is configured to receive a securing means, such as a post member 225 and a locking device 260, as discussed above. The locking device 260 is secured to the post member 225 thereby locking the projecting member 515 to the post member 225. Thus, the connector 510 cannot be removed from mating connector 215 without changing the state of the locking device 260 from a locked state to an unlocked state.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. For example, different size and shaped sheathing members can be used to accommodate different connectors. Therefore, the invention, in its broader aspects, is not limited to the specific details, the representative apparatus, and illustrative examples shown and described. Accordingly, departures may be made from such details without departing from the spirit or scope of the applicant's general inventive concept.

We claim:

1. A method of securing a connector to an electronic enclosure comprising:

installing a sheathing device at least partially around a connector wherein the sheathing device at least partially retains the connector; and securing the sheathing device to the electronic enclosure, wherein the securing step includes providing a locking device that has a locked state to prevent unauthorized disconnection of the connector from the electronic enclosure.

2. The method of claim 1 wherein installing the sheathing device at least partially around the connector comprises closing two halves of the sheathing device around the connector.

3. The method of claim 1 wherein installing the sheathing device at least partially around the connector comprises aligning at least one aperture with a post member on the electronic disclosure.

4. A method of securing a connector to an electronic enclosure comprising:

connecting a first connector portion that has a projecting member to a second mating portion mounted on the electronic enclosure, securing the projecting member to the electronic enclosure with a locking device wherein the locking device has a locked state and an unlocked state, and wherein changing the locked state to the unlocked state comprises accessing at least one of a key, a keycard, an access code, a password, or an internal space of the electronic device.

5. The method of claim 4 wherein the projecting member has an aperture that is configured to receive a post member and wherein the post member is capable of being secured to the electronic enclosure and the locking device is capable of preventing the connector from being removed from the post member while the locking device is in the locked state.

6. A method of securing a connector to an electronic enclosure comprising:

connecting a first connector portion that has a projecting member to a second mating portion mounted on the electronic enclosure, securing the projecting member to the electronic enclosure with a locking device wherein the locking device has a locked state and an unlocked state;

wherein the locking device is located inside of the enclosure.

7. A method of securing a connector to an electronic enclosure comprising:

connecting a first connector portion that has a projecting member to a second mating portion mounted on the electronic enclosure, securing the projecting member to the electronic enclosure with a locking device wherein the locking device has a locked state and an unlocked state;

wherein the locking device is a keyed locking device.

8. A method of securing a connector to an electronic enclosure comprising:

connecting a first connector portion that has a projecting member to a second mating portion mounted on the electronic enclosure, securing the projecting member to the electronic enclosure with a locking device wherein the locking device has a locked state and an unlocked state;

wherein the locking device is a combination locking device.

9. A method of securing a connector comprising:

providing a computer system having an associated input/output port, the port comprising a first projecting portion securable thereto;

providing a sheathing having a compartment for at least partially housing the connector and a second projecting portion having at least a partial opening;

inserting the connector at partially within the compartment;

inserting the first projecting portion at partially within the at least partial opening of the second projecting portion; and preventing complete withdrawal of the first projecting portion from the second projecting portion.

10. The method of claim 9 wherein preventing complete withdrawal comprises attaching a locking device to the first projecting portion.

11. The method of claim 9 wherein preventing complete withdrawal comprises at least partially securing the first portion to the second portion.

12. The method of claim 9 wherein preventing complete withdrawal comprises at least partially securing the first portion to the port.

13. The method of claim 9 wherein preventing complete withdrawal comprises attaching a locking device to an opening in the first projecting portion.

14. A method of securing a connector comprising:

step for providing a computer system having an associated input/output port, the port comprising a first projecting portion securable thereto;

step for providing a sheathing having a compartment for at least partially housing the connector and a second projecting portion having at least a partial opening;

step for inserting the connector at least partially within the compartment;

step for inserting the first projecting portion at partially within the at least partial opening of the second projecting portion; and step for preventing complete withdrawal of the first projecting portion from the second projecting portion.

15. The method of claim 14 wherein the step for preventing complete withdrawal comprises step for attaching a locking device to the first projecting portion.

16. The method of claim 14 wherein the step for preventing complete withdrawal comprises step for at least partially securing the first portion to the second portion.

17. The method of claim 14 wherein the step for preventing complete withdrawal comprises step for at least partially securing the first portion to the port.

18. The method of claim 14 wherein the step for preventing complete withdrawal comprises step for attaching a locking device to an opening in the first projecting portion.

19. The method of claim 14 wherein the step for preventing complete withdrawal comprises step for attaching a device the obstructs complete withdrawal of the first projecting portion from the second projecting portion.

* * * * *

UNITED STATES PATENT AND TRADEMARK OFFICE

CERTIFICATE OF CORRECTION

PATENT NO. : 7,155,822 B2
APPLICATION NO. : 10/917670
DATED : January 2, 2007
INVENTOR(S) : Jerry Decime et al.

It is certified that error appears in the above-identified patent and that said Letters Patent is hereby corrected as shown below:

In column 8, line 33, in Claim 19, delete “the” and insert -- that --, therefor.

Signed and Sealed this

Fifth Day of May, 2009

JOHN DOLL
*Acting Director of the United States Patent and Trademark Office*